US011504597B1

(12) United States Patent
Cotter

(10) Patent No.: US 11,504,597 B1
(45) Date of Patent: Nov. 22, 2022

(54) PUTTING PRACTICE ASSEMBLY

(71) Applicant: Colin Cotter, Hamilton (CA)

(72) Inventor: Colin Cotter, Hamilton (CA)

( * ) Notice: Subject to any disclaimer, the term of this patent is extended or adjusted under 35 U.S.C. 154(b) by 0 days.

(21) Appl. No.: 17/474,768

(22) Filed: Sep. 14, 2021

(51) Int. Cl.
*A63B 69/36* (2006.01)

(52) U.S. Cl.
CPC ..... *A63B 69/3661* (2013.01)

(58) Field of Classification Search
CPC ..... A63B 69/3661
USPC ..... 473/159–162, 197, 278, 279
See application file for complete search history.

(56) References Cited

U.S. PATENT DOCUMENTS 3,215,436 A 11/1965 Carter
5,655,974 A * 8/1997 Bair ..... A63B 69/3661 473/262
D405,839 S 2/1999 Childs
5,885,168 A * 3/1999 Bair ..... A63B 69/3661 473/262
6,106,409 A * 8/2000 Jackson, Jr. ..... A63B 69/3661 473/278
D443,909 S * 6/2001 Miraflor ..... D21/792
6,413,166 B1 7/2002 Long
6,672,970 B2 1/2004 Barlow
7,309,290 B2 12/2007 Hutchison
2005/0049069 A1* 3/2005 Speck ..... A63B 69/3661 473/278
2006/0217212 A1* 9/2006 Sindelar ..... A63B 69/3661 473/278
2009/0118025 A1 5/2009 Presezzi
2015/0209637 A1 7/2015 Curtis
2015/0247293 A1* 9/2015 Allingham ..... D04H 1/54 428/17
2015/0375082 A1 12/2015 Houser

FOREIGN PATENT DOCUMENTS

WO WO9919032 4/1999
WO WO-2012000537 A1 * 1/2012 ..... A63B 63/007

* cited by examiner

*Primary Examiner* — Nini F Legesse

(57) ABSTRACT

A putting practice assembly for practicing putting on a variety of putting green conditions includes a putting mat that is longitudinally elongated to simulate a putting lane. The putting mat has a plurality of sections and each of the sections has a unique texture with respect to each other. In this way each of the sections facilitates a unique golf ball speed with respect to each other for practicing putting in a variety of putting green conditions.

4 Claims, 4 Drawing Sheets

PUTTING PRACTICE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to putting devices and more particularly pertains to a new putting device for practicing putting in a variety of putting green conditions. The device includes a putting mat that has a plurality of elongated sections. Each of the elongated sections has a unique texture with respect to each other. In this way a golf ball that is putted on each of the sections will travel at a unique speed with respect to each other. Thus, a user can practice putting on a variety of putting green conditions that could potentially be encountered on a golf course.

(2) Description of Related Art Including Information Disclosed Under 37 CFR 1.97 and 1.98

The prior art relates to putting devices including an open celled putting surface with a stretching mechanism for practicing putting. The prior art discloses a putting practice device that includes a lower inflatable layer and an upper putting layer that can be positioned on the inflatable layer for practicing putting. The prior art discloses a variety of putting practice devices that is each strategically deformed to simulate an un-even putting green for practicing putting. The prior art discloses a putting practice pad that has a variety of target areas delineated for practicing putting over a range of varying distances.

BRIEF SUMMARY OF THE INVENTION

An embodiment of the disclosure meets the needs presented above by generally comprising a putting mat that is longitudinally elongated to simulate a putting lane. The putting mat has a plurality of sections and each of the sections has a unique texture with respect to each other. In this way each of the sections facilitates a unique golf ball speed with respect to each other for practicing putting in a variety of putting green conditions.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
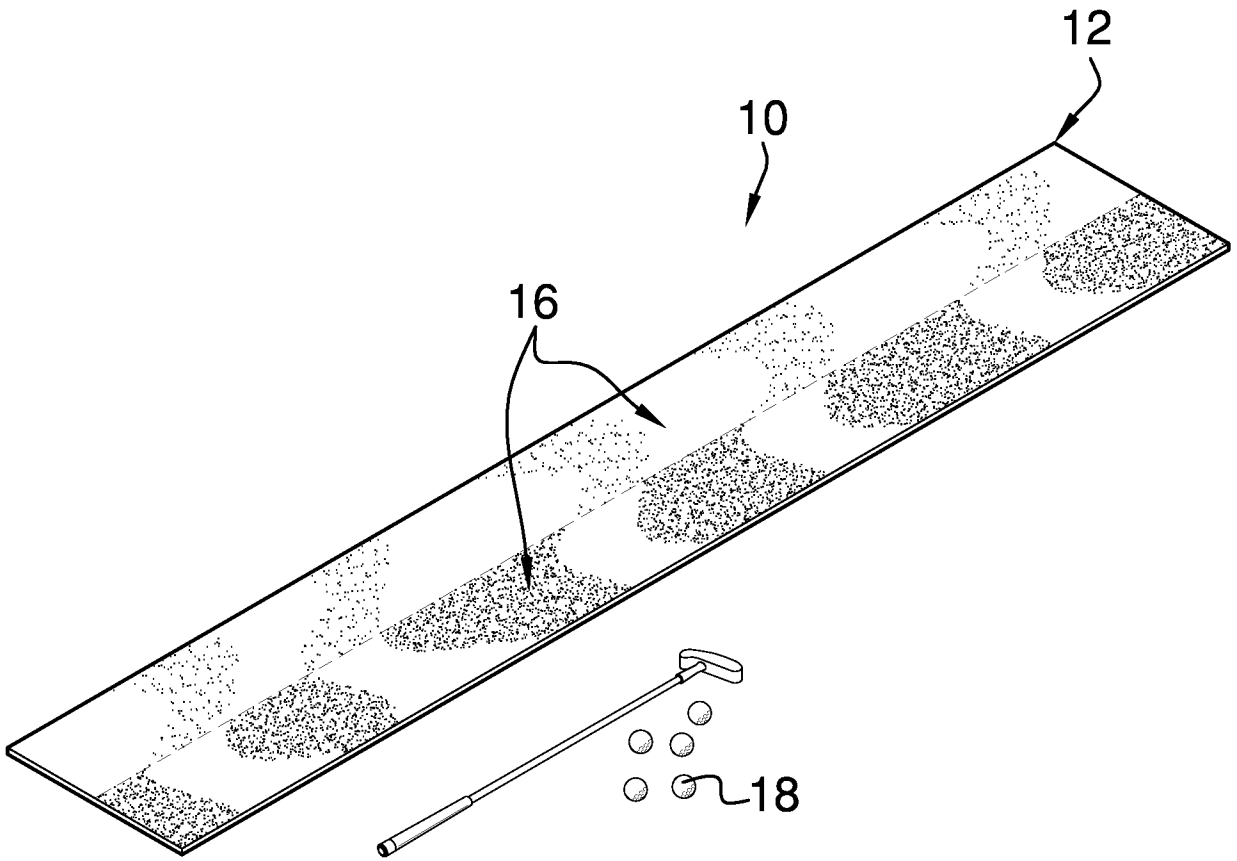
FIG. 1 is a perspective view of a putting practice assembly according to an embodiment of the disclosure.
Figure 2:
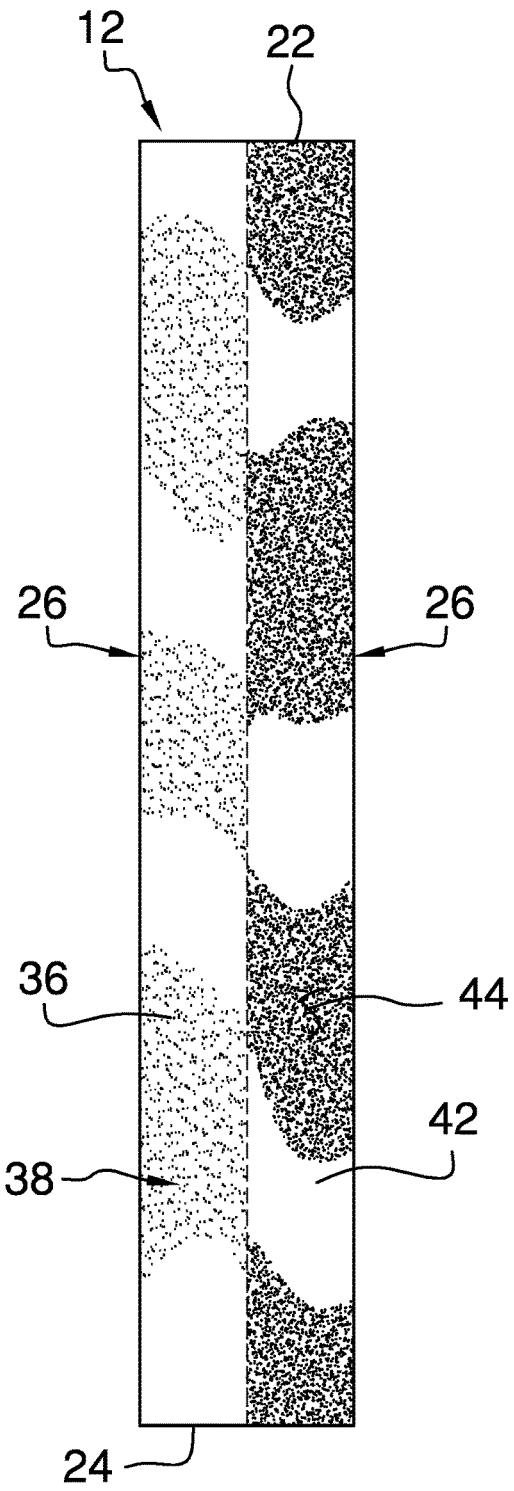
FIG. 2 is a top view of an embodiment of the disclosure.
Figure 3:
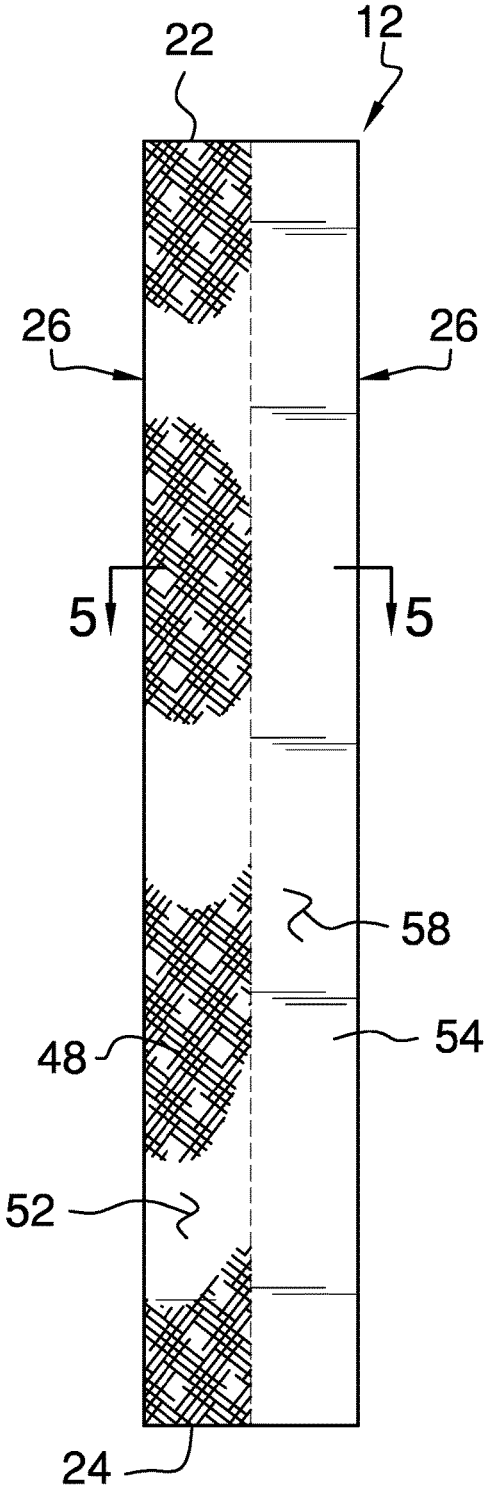
FIG. 3 is a bottom view of an embodiment of the disclosure.
Figure 4:
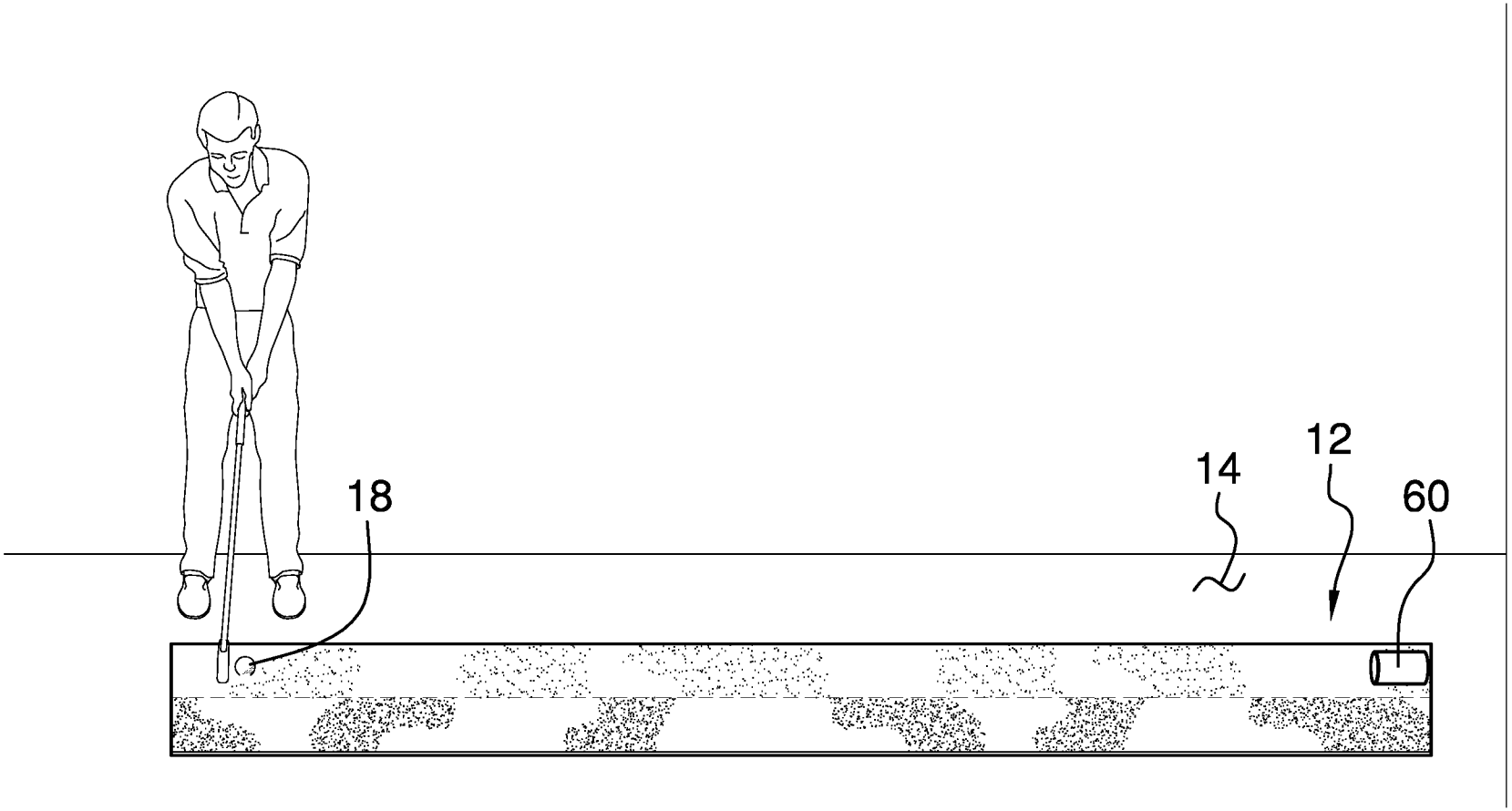
FIG. 4 is a perspective in-use view of an embodiment of the disclosure.
Figure 5:
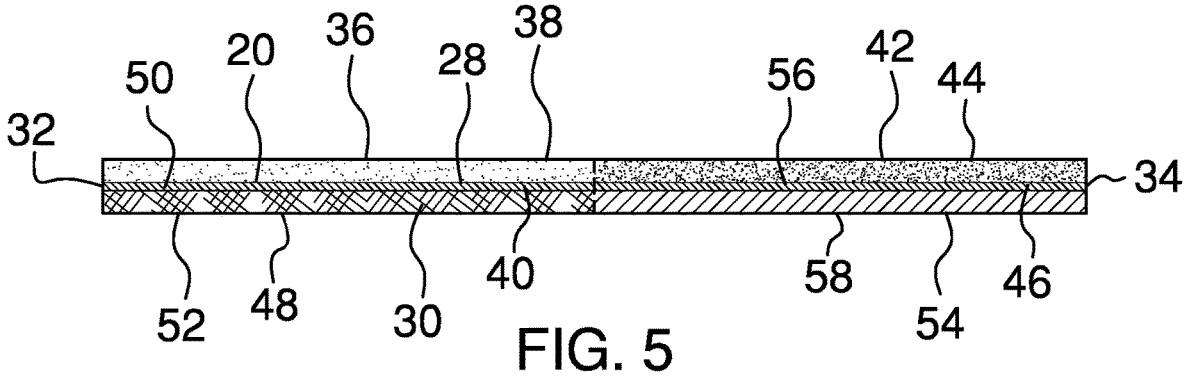
FIG. 5 is a cross sectional view taken along line 5-5 of FIG. 3 of an embodiment of the disclosure.

With reference now to the drawings, and in particular to FIGS. 1 through 5 thereof, a new putting device embodying the principles and concepts of an embodiment of the disclosure and generally designated by the reference numeral 10 will be described.

As best illustrated in FIGS. 1 through 5, the putting practice assembly 10 generally comprises a putting mat 12 that is longitudinally elongated. The putting mat 12 can be positioned on a support surface 14, such a floor or other horizontal support surface 14, to simulate a putting lane. The putting mat 12 may have a length ranging between approximately 8.0 feet and 12.0 feet and a width ranging between approximately 20.0 inches and 25.0 inches. The putting mat 12 has a plurality of sections 16 and each of the sections 16 has a unique texture with respect to each other. In this way each of the sections 16 facilitates a unique golf ball speed with respect to each other for practicing putting in a variety of putting green conditions. Thus, a golf ball 18 that is putted on each of the sections 16 will travel with a unique speed on each of the sections 16.

The putting mat 12 comprises a central layer 20 that has a first end 22, a second end 24 and an outer surface 26 extending between the first end 22 and the second end 24. The outer surface 26 has a top side 28 and a bottom side 30, and the central layer 20 is elongated between the first end 22 and the second end 24. The central layer 20 is comprised of a resiliently compressible material such as rubber or other similar type of material. Additionally, the central layer 20 has a first lateral edge 32 and a second lateral edge 34 that each extends between the first end 22 and the second end 24.

A first mat 36 is provided that has a top surface 38 and a bottom surface 40, and the bottom surface 40 is bonded to the top side 28 of the central layer 20. The first mat 36 extends between the first end 22 and the second end 24, and the first mat 36 extends from the first lateral edge 32 toward the second lateral edge 34. The top surface 38 is comprised of a material which poses a minimum amount of friction on the golf ball 18. In this way the first mat 36 facilitates the golf ball 18 to travel along the first mat 36 at a maximum speed. Thus, the first mat 36 facilitates a user 41 to practice putting on ideal conditions of a putting green.

A second mat 42 is provided which has a top surface 44 and a bottom surface 46, and the bottom surface 46 of the second mat 42 is bonded to the top side 28 of the central layer 20. The second mat 42 extends between the first end 22 and the second end 24 of the central layer 20, and the second mat 42 extends between the second lateral edge 34 of the central layer 20 and the first mat 36. The top surface 44 of the second mat 42 is comprised of a material which poses a first medial amount of friction on the golf ball 18. In this way the second mat 42 facilitates the golf ball 18 to travel along the second mat 42 at a first medial speed that is less than the maximum speed associated with the first mat 36. Thus, the second mat 42 facilitates the user 41 to practice putting from a fringe of a putting green.

A third mat 48 is provided that has a top surface 50 and a bottom surface 52, and the bottom surface 52 of the third mat 48 is bonded to the bottom side 30 of the central layer 20. The third mat 48 extends between the first end 22 and the second end 24 of the central layer 20, and the third mat 48 extends between the first lateral edge 32 of the central layer 20 toward the second lateral edge 34 of the central layer 20. The top surface 38 of the third mat 48 is comprised of a material which poses a second medial amount of friction on the golf ball 18. In this way the third mat 48 facilitates the golf ball 18 to travel along the third mat 48 at a second medial speed that is less than the first medial speed associated with the second mat 42. Thus, the third mat 48 facilitates the user 41 to practice putting on a golf course prior to playing a round of golf.

A fourth mat 54 is provided that has a top surface 56 and a bottom surface 58, and the bottom surface 58 of the fourth mat 54 is bonded to the bottom side 30 of the central layer 20. The fourth mat 54 extends between the first end 22 and the second end 24 of the central layer 20, and the fourth mat 54 extends between the second lateral edge 34 of the central layer 20 and the third mat 48. The top surface 56 of the fourth mat 54 is comprised of a material which poses a maximum amount of friction on the golf ball 18. In this way the fourth mat 54 facilitates the golf ball 18 to travel along the fourth mat 54 at a minimum speed that is less than the second medial speed associated with the third mat 48.

In use, the putting mat 12 is laid on the support surface 14 such that either the first mat 36 and the second mat 42 are exposed, or the third mat 48 and the fourth mat 54 is exposed, depending on the user's 41 preference. A cup 60, or other type of cylindrical receptacle, is placed on either the first mat 36, the second mat 42, the third mat 48 or the fourth mat 54. The user 41 then puts the golf ball 18 along either the first mat 36, the second mat 42, the third mat 48 or the fourth mat 54 toward the cup 60. In this way the user 41 can practice putting in a variety of different conditions that can potentially be encountered on a golf course.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A putting practice assembly having a plurality difference textures for simulating different putting conditions for facilitating different speeds of ball speed during putting, said assembly comprising:

a putting mat being longitudinally elongated wherein said putting mat is configured to be positioned on a support surface to simulate a putting lane, said putting mat having a plurality of sections, each of said sections having a unique texture with respect to each other wherein each of said sections is configured to facilitate a unique golf ball speed with respect to each other for practicing putting in a variety of putting green condition, said putting mat comprising a central layer having a first end and a second end, said central layer having a top side and a bottom side, said central layer being elongated between said first end and said second end, said central layer being comprised of a resiliently compressible material, said central layer having a first lateral edge and a second lateral edge which each extends between said first end and said second end;

a first mat having a minimum amount of friction for facilitating a maximum speed, said first mat being bonded to said top side of said central layer, said first mat extending along said first lateral edge and fully between said first end and said second end; and a second mat having a top surface and a bottom surface, said bottom surface of said second mat being bonded to said top side of said central layer, said second mat extending fully between said first end and said second end of said central layer, said second mat extending along said second lateral edge and between said second lateral edge of said central layer and said first mat wherein said first mat and said second mat cover an entirety of said top surface of said central laver, said top surface of said second mat being comprised of a material which poses a first medial amount of friction on the golf ball wherein said second mat is configured to facilitate the golf ball to travel along said second mat at a first medial speed being less than said maximum speed associated with said first mat.

2. The assembly according to claim 1, further comprising a third mat having a top surface and a bottom surface, said bottom surface of said third mat being bonded to said bottom side of said central layer, said third mat extending between said first end and said second end of said central layer, said third mat extending between said first lateral edge of said central layer toward said second lateral edge of said central layer, said top surface of said third mat being comprised of a material which poses a second medial amount of friction on the golf ball wherein said third mat is configured to facilitate the golf ball to travel along said third mat at a second medial speed being less than said first medial speed associated with said second mat.

3. The assembly according to claim 2, further comprising a fourth mat having a top surface and a bottom surface, said bottom surface of said fourth mat being bonded to said bottom side of said central layer, said fourth mat extending between said first end and said second end of said central layer, said fourth mat extending between said second lateral edge of said central layer and said third mat, said top surface of said fourth mat being comprised of a material which poses a maximum amount of friction on the golf ball wherein said fourth mat is configured to facilitate the golf ball to travel along said fourth mat at a minimum speed being less than said second medial speed associated with said third mat.

4. A putting practice assembly having a plurality difference textures for simulating different putting conditions for facilitating different speeds of ball speed during putting, said assembly comprising:

a putting mat being longitudinally elongated wherein said putting mat is configured to be positioned on a support surface to simulate a putting lane, said putting mat having a plurality of sections, each of said sections having a unique texture with respect to each other wherein each of said sections is configured to facilitate a unique golf ball speed with respect to each other for practicing putting in a variety of putting green conditions, said putting mat comprising:

a central layer having a first end and a second end, said central layer having a top side and a bottom side, said central layer being elongated between said first end and said second end, said central layer being comprised of a resiliently compressible material, said central layer having a first lateral edge and a second lateral edge which each extends between said first end and said second end;

a first mat having a top surface and a bottom surface, said bottom surface being bonded to said top side of said central layer, said first mat extending between said first end and said second end, said first mat extending from said first lateral edge toward said second lateral edge, said top surface being comprised of a material which poses a minimum amount of friction on a golf ball wherein said first mat is configured to facilitate the golf ball to travel along said first mat at a maximum speed;

a second mat having a top surface and a bottom surface, said bottom surface of said second mat being bonded to said top side of said central layer, said second mat extending between said first end and said second end of said central layer, said second mat extending along said second lateral edge and between said second lateral edge of said central layer and said first mat wherein said first mat and said second mat cover an entirety of said top surface of said central laver, said top surface of said second mat being comprised of a material which poses a first medial amount of friction on the golf ball wherein said second mat is configured to facilitate the golf ball to travel along said second mat at a first medial speed being less than said maximum speed associated with said first mat;

wherein said top surface of said first mat is coplanar with said top surface of said second mat;

a third mat having a top surface and a bottom surface, said bottom surface of said third mat being bonded to said bottom side of said central layer, said third mat extending between said first end and said second end of said central layer, said third mat extending between said first lateral edge of said central layer toward said second lateral edge of said central layer, said top surface of said third mat being comprised of a material which poses a second medial amount of friction on the golf ball wherein said third mat is configured to facilitate the golf ball to travel along said third mat at a second medial speed being less than said first medial speed associated with said second mat;

a fourth mat having a top surface and a bottom surface, said bottom surface of said fourth mat being bonded to said bottom side of said central layer, said fourth mat extending between said first end and said second end of said central layer, said fourth mat extending between said second lateral edge of said central layer and said third mat, said top surface of said fourth mat being comprised of a material which poses a maximum amount of friction on the golf ball wherein said fourth mat is configured to facilitate the golf ball to travel along said fourth mat at a minimum speed being less than said second medial speed associated with said third mat;

wherein said top surface of said third mat is coplanar with said top surface of said fourth mat; and wherein each of said first mat, said second mat, said third mat and said fourth mat defines a respective one of said sections of said putting mat.

* * * * *